US011274531B2

(12) United States Patent
Sansing

(10) Patent No.: US 11,274,531 B2
(45) Date of Patent: Mar. 15, 2022

(54) PRESSURE ACTIVATED SELECTIVE PERFORATING SWITCH SUPPORT

(71) Applicant: Hunting Titan, Inc., Houston, TX (US)

(72) Inventor: Joel Sansing, Wichita Falls, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 17/064,461

(22) Filed: Oct. 6, 2020

(65) Prior Publication Data

US 2021/0017841 A1 Jan. 21, 2021

Related U.S. Application Data

(62) Division of application No. 16/097,566, filed as application No. PCT/US2017/030661 on May 2, 2017, now Pat. No. 11,066,908.

(60) Provisional application No. 62/330,624, filed on May 2, 2016.

(51) Int. Cl.

| | |
|---|---|
| ***E21B 43/1185*** | (2006.01) |
| ***E21B 43/117*** | (2006.01) |
| ***F42D 1/055*** | (2006.01) |
| ***F42C 19/06*** | (2006.01) |
| ***F42B 3/12*** | (2006.01) |
| ***F42D 1/045*** | (2006.01) |
| ***F41A 19/70*** | (2006.01) |
| ***F41A 19/65*** | (2006.01) |
| ***F42D 1/04*** | (2006.01) |

(52) U.S. Cl.

CPC ..... *E21B 43/1185* (2013.01); *E21B 43/117* (2013.01); *F41A 19/65* (2013.01); *F41A 19/70* (2013.01); *F42B 3/12* (2013.01); *F42C 19/06* (2013.01); *F42D 1/04* (2013.01); *F42D 1/045* (2013.01); *F42D 1/055* (2013.01)

(58) Field of Classification Search

CPC .... E21B 43/117; E21B 43/1185; F42C 19/06; F42C 19/65; F42C 19/70

See application file for complete search history.

(56) References Cited

U.S. PATENT DOCUMENTS

| | | | | |
|---|---|---|---|---|
| 4,234,768 | A | 11/1980 | Boop | |
| 4,266,613 | A | 5/1981 | Boop | |
| 4,544,034 | A | 10/1985 | George | |
| 4,762,179 | A | 8/1988 | Wesson et al. | |
| 10,180,049 | B1 * | 1/2019 | Trafton | H01H 35/38 |
| 2010/0319930 | A1 | 12/2010 | Evans | |
| 2013/0126237 | A1 | 5/2013 | Burton et al. | |

(Continued)

FOREIGN PATENT DOCUMENTS

EP 3298233 A1 8/2016

OTHER PUBLICATIONS

Notification of transmittal of the International Search Report and the Written Opinion of the International Searching Authority, or the Declaration, PCT application No. PCT/US17/30661 dated Oct. 2, 2017, 13 pages.

(Continued)

*Primary Examiner* — Robert E Fuller
*Assistant Examiner* — Lamia Quaim
(74) *Attorney, Agent, or Firm* — Christopher McKeon; Jason Saunders; Arnold & Saunders, LLP

(57) ABSTRACT

A method, system, and apparatus for restraining a firing pin using a bushing for use in a downhole switch that is armed using the explosive energy of a previously detonated shaped charge.

8 Claims, 3 Drawing Sheets

(56) References Cited

U.S. PATENT DOCUMENTS

| | | | |
|---|---|---|---|
| 2013/0291751 | A1 | 11/2013 | Sickels |
| 2016/0215597 | A1 | 7/2016 | LaGrange et al. |

OTHER PUBLICATIONS

Communication with Supplementary European Search Report, PCT application No. PCT/US17/30661 dated Jan. 16, 2020, 11 pages.
Office action, Canadian application No. 3,022,857, dated Sep. 26, 2019, 4 pages.

* cited by examiner

PRESSURE ACTIVATED SELECTIVE PERFORATING SWITCH SUPPORT

RELATED APPLICATIONS

This application is a U.S. divisional patent application of U.S. Nonprovisional patent application Ser. No. 16/097,566 filed Oct. 29, 2018, which is a 371 of International Application No. PCT/US17/30661 filed May 2, 2017, which claims priority to U.S. Provisional Application No. 62/330,624, filed on May 2, 2016.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock.

A perforating gun has a gun body. The gun body typically is composed of metal and is cylindrical in shape. Within a typical gun tube is a charge holder or carrier tube, which is a tube that is designed to hold the actual shaped charges. The charge holder will contain cutouts called charge holes where the shaped charges will be placed.

A shaped charge is typically detonated by a booster or igniter. Shaped charges may be detonated by electrical igniters, pressure activated igniters, or detonating cord. One way to ignite several shaped charges is to connect a common detonating cord that is placed proximate to the igniter of each shaped charge. The detonating cord is comprised of material that explodes upon ignition. The energy of the exploding detonating cord can ignite shaped charges that are properly placed proximate to the detonating cord. Often a series of shaped charges may be daisy chained together using detonating cord.

Another type of explosive used in completions is a jet cutter. This is an explosive that creates a radial explosion. It can be used to sever tubulars, including downhole casing.

A firing head is used to detonate the detonating cord in the perforating gun. The firing head may be activated by an electrical signal. Electricity may be provided by a wireline that ties into the cablehead at the top of a tool string. The electrical signal may have to travel through several components, subs, and tools before it gets to the firing head. A reliable electrical connector is needed to ensure the electrical signal can easily pass from one component to the next as it moves down the tool string. The electrical signal is typically grounded against the tool string casing. As a result, the electrical connections must be insulated from tool components that are in electrical contact with the tool string casing.

SUMMARY OF EXAMPLE EMBODIMENTS

An example embodiment may include a switch for use downhole including an outer cylindrical housing having a common axis and a thru bore, an inner cylindrical housing located within the thru bore of the outer cylindrical housing having an outer surface and a thru bore where the outer surface is electrically insulated from the thru bore, a cylindrical electrically conductive receptacle having a thru bore and located within the thru bore of the inner cylindrical housing, an electrically conductive piston with a first end having a conical cavity, a distal end, and a radial groove about the distal end, an electrically insulating piston sleeve surrounding the circumference of the first end of the piston, an electrically conductive firing pin having a first cylindrical segment, a second cylindrical segment, and a third cylindrical segment, wherein the first cylindrical segment is slideably engaged with the inner thru bore of the receptacle, the second cylindrical segment is slideably engaged with the thru bore of the inner cylindrical housing, the third cylindrical segment having a conical distal end located adjacent to the conical bore of the piston, and an electrically insulating bushing with a base end, a cylindrical sleeve, a distal end, and an inner bore, wherein the inner bore is slideably engaged with the distal end of the piston, wherein the circumferential groove of the distal end of the piston extends beyond the distal end of the bushing, and wherein the base end of the bushing is proximate to the piston sleeve.

A variation of the example embodiment may include the bushing base end being proximate to the outer housing. The distal end of the bushing may be proximate to the circumferential groove of the distal end of the piston. An o-ring, retainer ring, or shear pin may be located in the circumferential groove of the distal end of the piston. The first cylindrical segment of the firing pin may be covered in Teflon. The first cylindrical segment of the firing pin may be covered in an electrically non-conductive material. A first wire may be electrically coupled to the first cylindrical segment of the firing pin. A second wire may be electrically coupled to the outer cylindrical housing. A diode may be in series with the second wire.

Further variations may include having a retainer end cap with an inner frusto conical surface ending in a thru bore wherein the thru bore is slideably engaged with the cylindrical wall of the bushing. A cylindrical end cap retainer having a frusto-conical thru bore with an inner shoulder, a countersink end, wherein the inner shoulder is slideably engaged with the cylindrical sleeve of the support bushing and the countersink end fits flush over the support bushing cylindrical sleeve and also fits flush against the second face of the cylindrical housing. The shoulder of the base end of the bushing may be disposed between the trainer and the outer housing. The cylindrical base of the bushing may have an outer diameter of 0.505 inches. The cylindrical base of the bushing may have a thickness of 0.035 inches. The sleeve of the bushing may have an outer diameter of 0.31 inches. The thru bore of the bushing may have a diameter of 0.19 inches. The total length of the bushing from the base end to the distal end may be 0.349 inches. The sleeve of the bushing may have a length of 0.314 inches. The interface of the sleeve portion with the base portion forms a shoulder. The shoulder may be approximately 0.0975 inches wide.

Another example embodiment may include a switch for use downhole including a cylindrical housing with a common axis, a first face, a second face, and a through bore, a cylindrical firing piston protruding from the first face and having a distal end with a circumferential groove, wherein the cylindrical firing piston is slideably engaged with the cylindrical housing, a support bushing having a cylindrical sleeve with a distal end, a cylindrical base, and a thru bore, wherein the cylindrical sleeve is slideably engaged with firing piston, a cylindrical end cap retainer having a frustoconical thru bore with an inner shoulder, a countersink end, wherein the inner shoulder is slideably engaged with the cylindrical sleeve of the support bushing and the countersink end fits flush over the support bushing cylindrical sleeve and also fits flush against the second face of the cylindrical housing, wherein the shoulder of the base end of the support bushing is between the cylindrical end cap retainer and the second face of the cylindrical housing.

A variation of the disclosed embodiment may include the distal end of the support bushing being proximate to the circumferential groove on the firing piston. An o-ring, retainer ring, or shear pin may be disposed in the circumferential groove of the distal end of the firing piston designed such that the explosive force from the detonation of an adjacent perforating gun will shear the o-ring, retainer ring, or shear pin against the support bushing.

The embodiment may include a firing pin assembly may be disposed within the cylindrical housing further including a first cylindrical segment covered in an electrically non-conductive material, a second cylindrical segment that is electrically conductive, wherein the second cylindrical segment is adapted to fit into an electrically conductive receptacle, a first wire electrically coupled to the first cylindrical segment of the firing pin, a second wire electrically coupled to the receptacle, a diode in series with the second wire. A retainer located within the circumferential groove may be sized such that its greatest outer diameter is greater than the diameter of the support bushing thru bore.

Another example embodiment may include a system for use downhole including at least one perforating gun with a first end and a second end, the first end being coupled to a first tandem sub, at least one shaped charge installed within a charge tube located within the at least one perforating gun, a detonating cord coupled to the at least one shaped charge, a detonator coupled to the detonating cord and installed in the tandem sub, an arming switch electrically coupled to the detonator, the arming switch further including an electrically conductive outer cylindrical housing having a common axis and a thru bore, an electrically insulating inner cylindrical housing located within the thru bore of the outer cylindrical housing and having a thru bore, an electrically conductive cylindrical receptacle having a thru bore and located within the thru bore of the inner cylindrical housing, an electrically conductive piston with a first end having a conical bore and a distal end having a proximately located circumferential groove, an electrically conductive firing pin having a first cylindrical segment, a second cylindrical segment, and a third cylindrical segment, wherein the first cylindrical segment is slideably engaged with the inner thru bore of the receptacle, the second cylindrical segment is slideably engaged with the thru bore of the inner cylindrical housing, the third cylindrical segment having a conical distal end located adjacent to the conical bore of the piston, and a bushing with a disc base end, a cylindrical wall, a distal end, and an inner bore, wherein the inner bore is slideably engaged with the distal end of the piston.

A variation of the example embodiment may include the distal end of the bushing being aligned with the circumferential groove of the distal end of the piston. An o-ring, retainer ring, or shear pin may be disposed in the circumferential groove of the distal end of the piston. The first cylindrical segment of the firing pin may be covered in electrically non-conductive material such as Teflon. The second cylindrical segment of the firing pin may be electrically conductive. The receptacle may be electrically conductive. A first wire electrically may be coupled to the first cylindrical segment of the firing pin. A second wire may be electrically coupled to the receptacle. A diode may be in series with the second wire. It may include a retainer end cap with an inner frusto conical surface ending in a thru bore wherein the thru bore is slideably engaged with the cylindrical wall of the bushing. The second end being coupled to a second tandem sub.

Another example embodiment may include a method for detonating a shaped charge including assembling at least one perforating gun to at least one tandem sub, installing at least one perforating shaped charge in the at least one perforating gun, installing at least at least one detonator in the at least one tandem sub, installing a detonating cord between the detonator and the at least one shaped charge, installing a switch in the tandem sub, assembling an arming switch for a downhole perforating gun with a firing piston having a distal end protruding from the switch, machining a groove on a distal end of the piston, engaging a support busing on the distal end of the piston, wherein the support bushing is located between the switch housing and the machined groove, and installing a retaining device on the machined groove, wherein the retaining device engages with the support bushing.

A variation of the disclosed example may include detonating a second shaped charge, wherein the detonation activates the switch and arms the at least one detonator. It may also include electrically activating the at least one detonator.

Another example embodiment may include a support bushing for retaining a firing piston comprising a cylindrical base end having a longitudinal axis, a cylindrical sleeve portion sharing the longitudinal axis and protruding from the base end and having a distal end, wherein the sleeve portion has a larger outer diameter that is smaller than a largest out diameter of the base end, and a thru bore sharing the common axis, wherein the support busing is adapted to slideably engage a firing piston.

A variation of the disclosed example may include the cylindrical base having an outer diameter of 0.505 inches, the cylindrical base having a thickness of 0.035 inches, the sleeve having an outer diameter of 0.31 inches, the thru bore having a diameter of 0.19 inches, the total length of the support bushing from the base end to the distal end being 0.349 inches, the sleeve having a length of 0.314 inches, and the sleeve portion forming a shoulder with the base portion with the shoulder being approximately 0.0975 inches wide.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
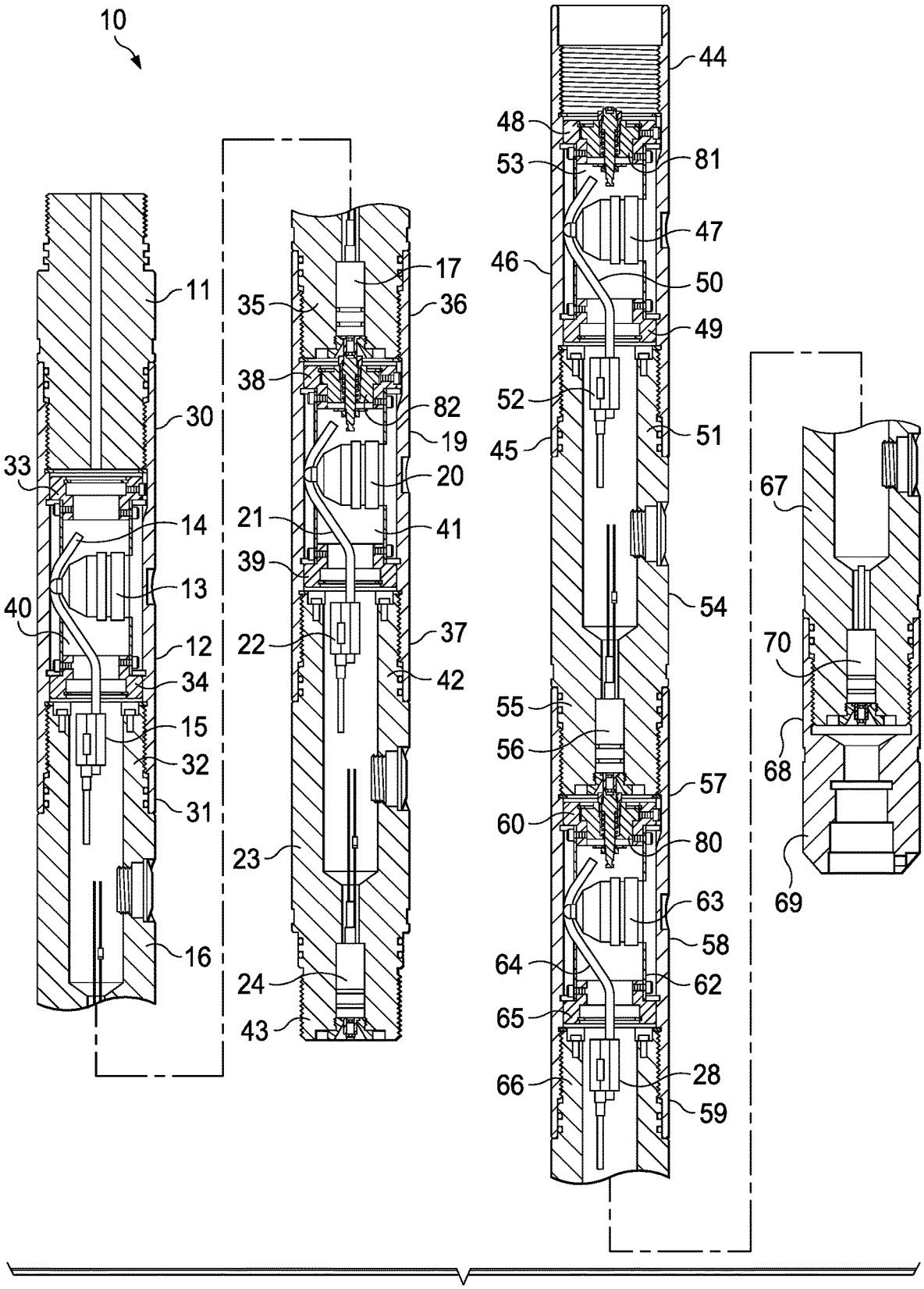
FIG. 1 shows a side view cutaway of a downhole gun string.

An example embodiment is shown in FIG. 1 depicting a gun string 10 that can be used in conjunction with wireline or some other downhole conveyance system. This example may be affixed to a setting tool that may seal a borehole at a predetermined location prior to a series of one or more controlled detonations of shaped charges located in the gun string 10. In this example the "top" of the gun string 10 starts with the top sub 11. The top sub 11 is coupled to the first end 30 of the first gun 12. The first gun 12 has a shaped charge 13 housed within a charge tube 40 that is held in place by end fitting 33 and end fitting 34. The shaped charge 13 is coupled to a detonating cord 14. The second end 31 of the first gun 12 is coupled to first end 32 of the tandem sub 16. A detonator 15 is located within the tandem sub 16 and coupled to the detonating cord 14. The detonator 15 is electrically fired from an electrical signal sent from the surface. The explosion resulting from the electrical signal is conveyed from the detonator 15 to the shaped charge 13 via the detonating cord 14. The second end 35 of the tandem sub 16 contains a pressure switch 17 held in place by a retainer bushing in conjunction with an o-ring and a retainer support holding securing the retainer bushing. The pressure switch 17 is normally open until energy from an adjacent explosion causes the switch to close. Without the pressure switch 17 closed the detonator 16 cannot be electrically detonated.

The second gun 19 has a first end 36 coupled to the second end 35 of the first tandem sub 16. The second end 37 of the second gun 19 is coupled to the first end 42 of the second tandem sub 23. The second gun 19 has a shaped charge 20 located within a charge tube 41, which is held in place by a first end fitting 38 and a second end fitting 39. A detonating cord 21 is connected to the shaped charge 20. The detonating cord 21 is connected to detonator 22. Detonator 22 is connected to the pressure switch 24 located at the second end 43. The pressure switch 24 is in a normally open position. Explosive energy is used to close the pressure switch 24.

The second end 43 of the tandem sub 23 is couple to the first end 44 of the third gun 46. The third gun 46 contains a charge tube 53 held in place by a first end fitting 48 and a second end fitting 49. The charge tube 53 contains shaped charge 47 coupled to a detonating cord 50. The detonating cord 50 is coupled to the detonator 52, which is electrically coupled to the pressure switch 56. The second end 45 of the third gun 46 is coupled to the first end 51 of the third tandem sub 54. The second end 55 of the third tandem sub 54 contains a pressure switch 56. The second end 55 of the third tandem sub 54 is coupled to the first end 57 of the fourth gun 58. Gun 58 contains a shaped charge 63 coupled to a detonating cord 64 located within a charge tube 62, which is held in place by end fitting 60 and end fitting 65. The detonating cord 64 is coupled to the detonator 28 located in the first end 66 of the fourth tandem sub 67. The second end 59 of the fourth gun 58 is coupled to the first end 66 of the fourth tandem sub 67. Tandem sub 67 has a second end 68 that houses an igniter 70 for use in activating a setting tool. The bottom sub 69 is coupled to the second end 68 of the fourth tandem sub 67.

An example of the gun string 10 in operation would start with first assembling the gun string and then lowering it into a borehole. The gun string 10 in this configuration is for use with wireline. It may be lowered by force of gravity, or conveyed to a desired location using a tractor, pumping down, or other method of locating the gun string. It may deploy a bridge plug by activating igniter 70 once in its desired location. Then the gun string will be either moved to a new desired location or one or more guns will be fired at the first location. The firing of gun 58 is accomplished by activating detonator 28 with an electrical signal, which then ignites detonating cord 64 and shaped charge 63.

The explosive energy released from the detonation of shaped charge 63 transmits energy through the feed thru puck assembly 80, which mechanically closes the switch 56. With the switch 80 closed, the next electrical fire signal will cause detonator 52 to detonate gun 46. Again, the explosive energy released from gun 46 will close switch 24 via feed thru puck assembly 81. With switch 24 closed, the next firing signal will activate detonator 22, thus firing gun 19. Gun 19 will close switch 17 via feed thru puck 82. The next electrical signal from the surface will then activate detonator 15, thus detonating gun 12. This selective firing of each gun can be accomplished in a single location or in multiple locations. This design ensures that the each perforating gun arms the next perforating gun. It also signals to the surface each time a switch is closed that the previous gun did in fact detonate as commanded.

Figure 2:
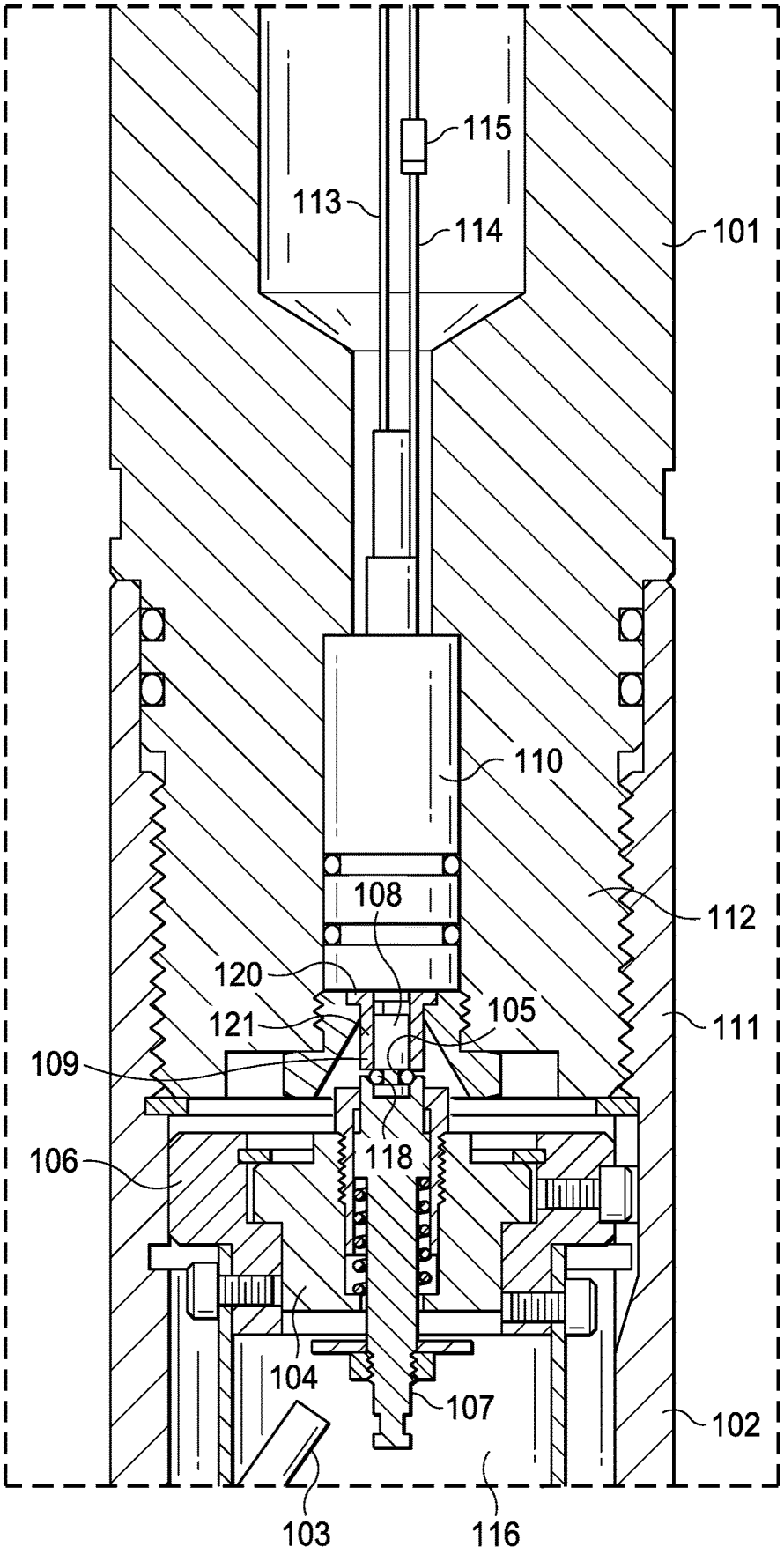
FIG. 2 shows a side view cutaway close up of a switch used to detonate a perforating gun.

A closer look at the switch within a gun string is provided in FIG. 2. A gun string 100 has a tandem sub 101 with a distal end 112 coupled to a box end 111 of a perforating gun 102. The perforating gun 102 has charge tube 116 that contains one or more shaped charges. Detonating cord 103 is used to detonate the one or more shaped charges. Feed thru puck assembly 104 is located within end fitting 106. The stem 107 located coaxially within the feed thru puck 104 and the end fitting 106 is in contact with the firing piston 108. Firing piston 108 has a circumferential groove 105 with an o-ring 118. Firing piston 108 travels axially through the switch 110. A bushing 109 is used in combination with the o-ring 118 to restrain the firing piston 108 in the initial open position. The o-ring 117 holds the bushing 109 in place. In this example the firing piston 108 has an o-ring 118, however it may be a different type of straining device such as a snap ring, a washer, or a shear pin. The bushing 109 has a base portion 120 and a sleeve portion 121.

Upon the detonation of gun 102, the stem 107 travels axially through the feed thru puck 104 and mechanically translate the firing piston 108 into the switch 110. The energy transferred from the detonating gun 102 is sufficient to shear the o-ring 118 against the bushing 109, thus allowing the firing piston 108 to travel freely into the switch 110. The axial movement of the firing piston 108 causes the switch 110 to close, thus putting wire 113 and wire 114 into electrical contact with each other. A diode 115 controls the direction of current needed to activate the subsequent electrical signal to activate a detonator.

Figure 3:
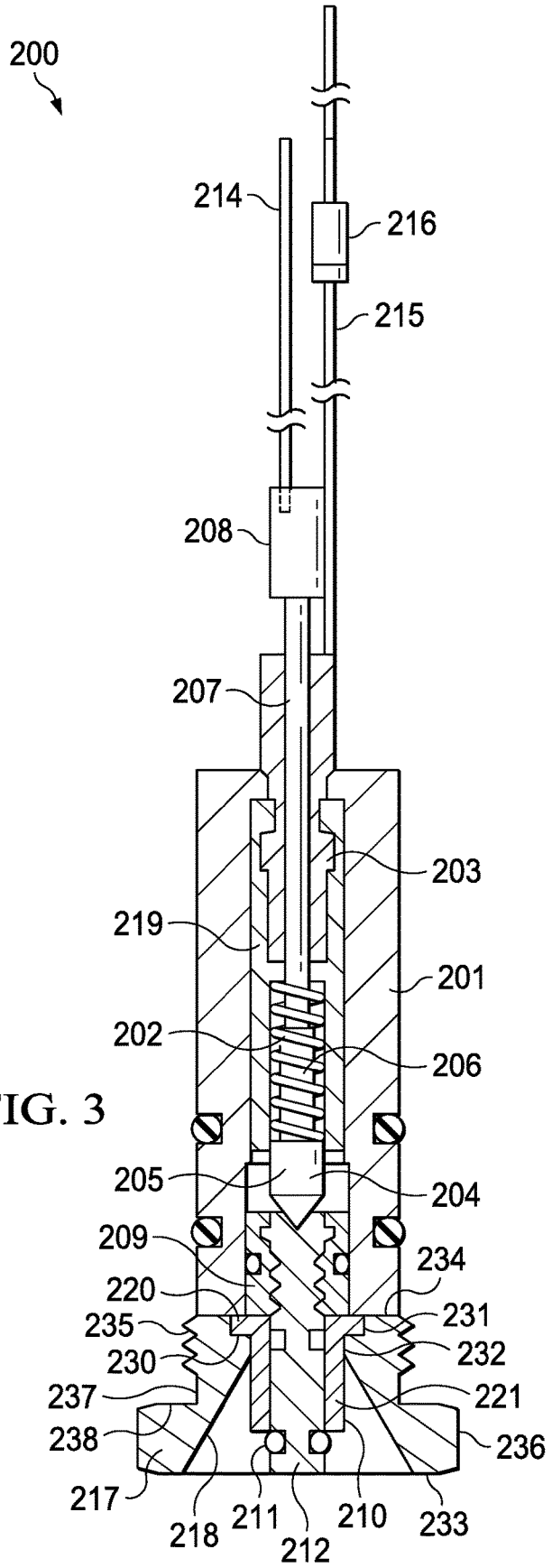
FIG. 3 shows a side view of a switch assembly used to detonate a perforating gun.

A view of the internals of an example switch is provided in FIG. 3. The switch assembly 200 includes an outer housing 201, an electrically insulating inner housing 219, an electrically conductive firing pin 204, an electrically conductive firing piston 212, an electrically insulating piston sleeve 209, a bushing 210, and a retainer 217. An electrically conductive receptacle 203 is located within the inner housing 219. The firing piston 212 has an o-ring 211 located within a circumferential groove that interferes with the bushing 210 to prevent the firing piston 212 from moving axially. The bushing 210 has a base 220 and a sleeve 221. The sleeve 221 of the bushing 210 allows the bushing 210 to axially aligned with and be slideably engaged with the firing piston 212. The retainer 217 has an inner frusto-conical surface 218. Grease is located between the inner housing 219 and the firing pin 204. The firing pin 204 has three primary segments. The first segment 205 mechanically interfaces with the firing piston 212 and has a conical shaped distal end. The second segment 206 is an exposed metal section that is initially kept out of the receptacle 203. The third segment 207 is wrapped in an electrically insulative material, such as Teflon, thus preventing an electrical circuit from the third segment 207 through receptacle 203. A first wire 214 is secured to the third segment 207 of the firing pin 204 via wire coupler 208. A spring 202 preloads the firing pin 204 and operates, in conjunction with grease, to moderate the axial movement of the firing pin 204 when it is armed. When a shaped charge is detonated the explosive force causes the o-ring 211 to shear against the busing 210. The firing piston 212 moves axially against the firing pin 204 and forces it axially into the inner housing 219. The electrically conductive second segment 206 of firing pin 204 is then moved into contact with the receptacle 203. The receptacle 203 is in electrical communication with the second wire 215. Thus, the switch is closed when an adjacent shaped charge is fired. Diode 216 controls the direction of current necessary to then detonate the next now armed detonator.

The retainer 217 has a shoulder 230 formed from a countersink 231 that is adapted to fit flush with the base 220 of the bushing 210. The surface 234 of the retainer 217 fits flush against the outer housing 201. The inner surface 232 of the trainer 217 fits flush against the sleeve 221 of the bushing 210. The end cap portion 236 of the retainer 217 has an outer surface 233. The neck of the retainer 217 has a threaded portion 235 and a thread relief 237. Shoulder 238 allows the retainer 217 to fit flush against a tandem sub.

Figure 4A:
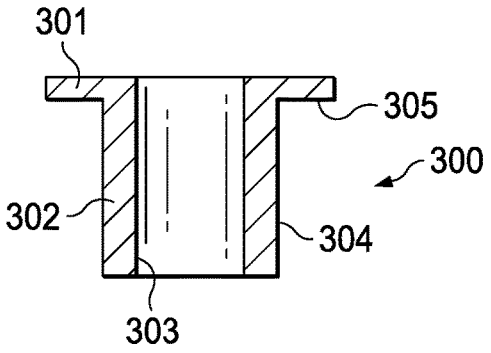
FIG. 4*a* shows a view of a bushing used in a switch assembly.
Figure 4B:
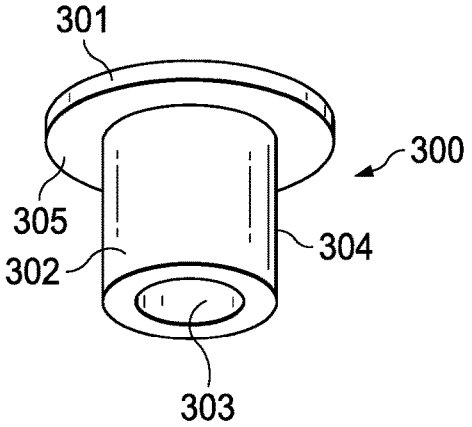
FIG. 4*b* shows a view of a bushing used in a switch assembly.

A depiction is shown in FIGS. 4*a* and 4*b* of a bushing 300 used to initially restrict the axial travel of a firing piston. The bushing 300 has a flat circular base 301, a sleeve 302, and a thru-bore 303. Potential dimensions for the bushing 300 may include the base have an outer diameter of approximately 0.505 inches and a thickness of approximately 0.035 inches. The sleeve 302 may have an outer diameter 304 of approximately 0.310 inches and the thru-bore may have a diameter of approximately 0.19 inches. The overall length of the bushing 300 may be approximately 0.349 inches. The length of the sleeve portion is approximately 0.314 inches. The distal end of the sleeve 302 engages with a retaining device, such as an o-ring, snap ring, or set screw in a firing piston that is slideably engaged with the thru bore 303, which limits the axial movement of the firing piston until an explosive force causes the retaining device to shear or fail. Shoulder 305 engages with a retainer screwed over the bushing 300. The shoulder 305 may be approximately 0.0975 inches thick.

Although the invention has been described in terms of particular embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A switch for use downhole comprising:

a cylindrical housing with a common axis, a first face, a second face, and a through bore;

a cylindrical firing piston protruding from the first face and having a distal end with a circumferential groove, wherein the cylindrical firing piston is slideably engaged with the cylindrical housing;

a support bushing having a cylindrical sleeve with a distal end, a cylindrical base end, a shoulder formed by the cylindrical base end and the cylindrical sleeve, and a thru bore, wherein the cylindrical sleeve is slideably engaged with the firing piston;

a cylindrical end cap retainer having a frusto-conical thru bore with an inner shoulder, a countersink end, wherein the inner shoulder is engaged with the cylindrical sleeve of the support bushing and the countersink end fits flush over the support bushing cylindrical sleeve and also fits flush against the second face of the cylindrical housing;

wherein the shoulder formed by the cylindrical base end and the cylindrical sleeve of the support bushing is between the cylindrical end cap retainer and the second face of the cylindrical housing.

2. The apparatus of claim 1 wherein the distal end of the support bushing is proximate to the circumferential groove on the firing piston.

3. The apparatus of claim 1 further comprising an o-ring in the circumferential groove of the distal end of the firing piston.

4. The apparatus of claim 1 further comprising a retainer ring in the circumferential groove of the distal end of the firing piston.

5. The apparatus of claim 1 further comprising a shear pin in the circumferential groove of the distal end of the piston.

6. The apparatus of claim 1 further comprising a firing pin assembly disposed within the cylindrical housing further comprising:

a first cylindrical segment covered in an electrically non-conductive material;

a second cylindrical segment that is electrically conductive, wherein the second cylindrical segment is adapted to fit into an electrically conductive receptacle;

a first wire electrically coupled to the first cylindrical segment of the firing pin;

a second wire electrically coupled to the receptacle;

a diode in series with the second wire.

7. The apparatus of claim 3 wherein an explosive force from the detonation of an adjacent perforating gun will shear the o-ring against the support bushing.

8. The apparatus of claim 1 further comprising a retainer located within the circumferential groove sized such that its greatest outer diameter is greater than the diameter of the support bushing thru bore.

* * * * *